United States Patent [19]

Gionet et al.

[11] Patent Number: 4,914,859

[45] Date of Patent: Apr. 10, 1990

[54] AUTOMATIC DOOR SAFETY SYSTEM

[75] Inventors: Daniel C. Gionet; Lance Wikkerink; Harry V. Nguyen, all of St. Petersburg, Fla.

[73] Assignee: Lanson Electronics, Inc., Pinellas Park, Fla.

[21] Appl. No.: 248,133

[22] Filed: Sep. 23, 1988

Related U.S. Application Data

[63] Continuation of Ser. No. 38,957, Apr. 16, 1987, abandoned.

[51] Int. Cl.[4] ..... E05F 15/20

[52] U.S. Cl. ..... 49/25; 49/26

[58] Field of Search ..... 49/25, 26, 28

[56] References Cited

U.S. PATENT DOCUMENTS 3,857,466 12/1974 Berkovitz et al. ..... 49/25
3,903,996 9/1975 Berkovitz ..... 49/25
4,297,383 10/1987 Hagiwara ..... 49/25

FOREIGN PATENT DOCUMENTS 3202784 8/1983 Fed. Rep. of Germany ..... 49/25

*Primary Examiner*—Kenneth J. Dorner
*Assistant Examiner*—Gerald A. Anderson
*Attorney, Agent, or Firm*—Walter J. Monacelli; Joseph R. Teagno

[57] ABSTRACT

Mechanism primarily suited to automatic sliding door applications wherein at least a pair of object presence sensing detectors, preferably of the ultra-sonic transducer type are arranged to be placed in linear spaced relation to one another effective to cast sonic beams produced thereby spanning the doorway to which applied. So as to assure satisfactorily a beam path to be intercepted by an object stationary or moving in the beams, they are purposely overlapped. The door upon being operatively moved by motion sensing detectors or manual means acts at different opening positions to switch the object sensing detectors on and upon reverse closing positions switches the object sensing detectors off.

18 Claims, 2 Drawing Sheets

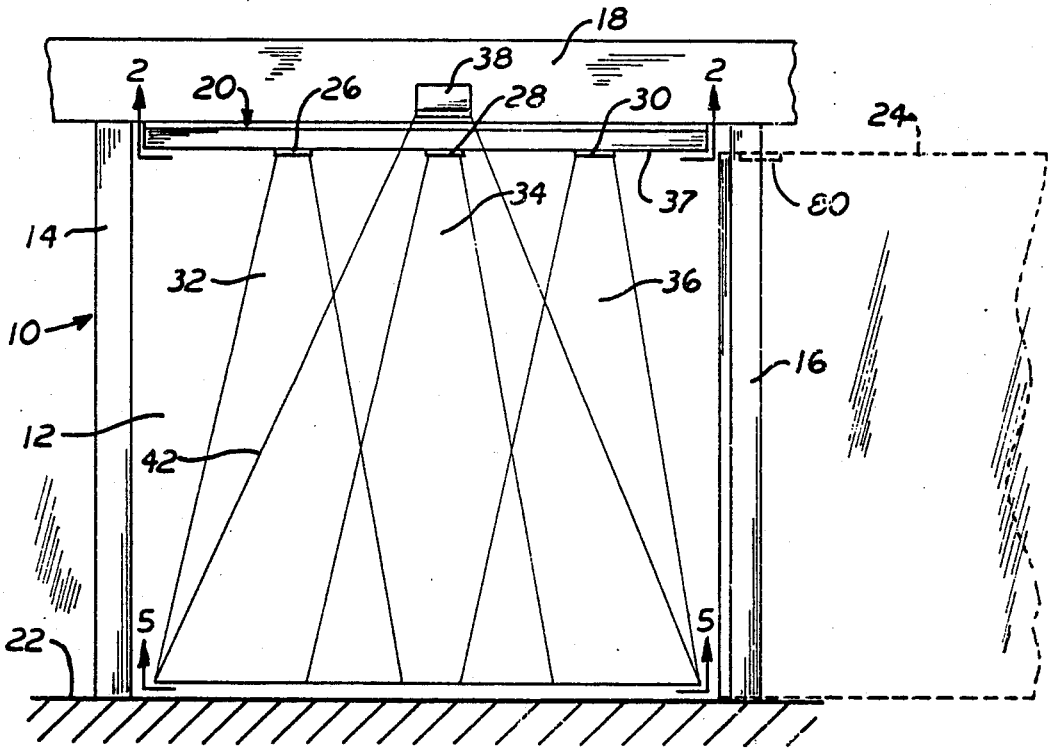
FIG. 1
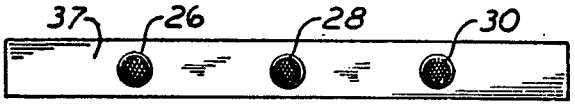
FIG. 2
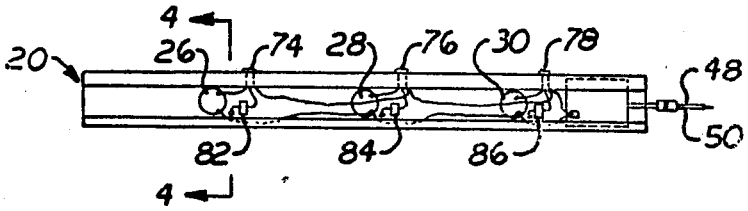
FIG. 3
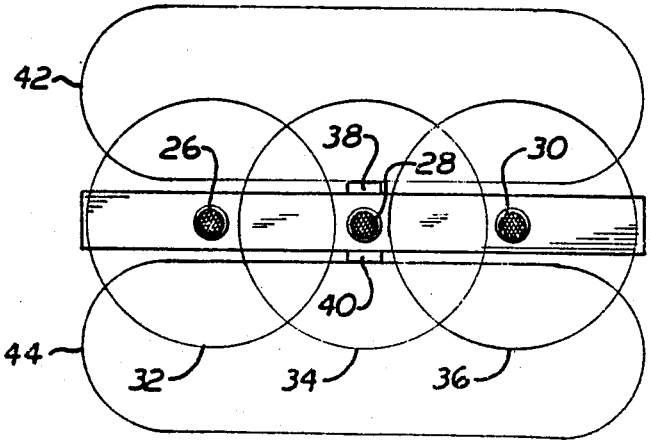
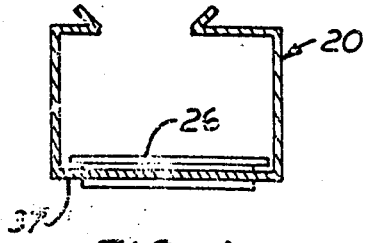
FIG. 4

AUTOMATIC DOOR SAFETY SYSTEM

This is a continuation of pending application Ser. No. 07/038,957, filed April 16, 1987, now abandoned.

BACKGROUND OF THE INVENTION

1. Field of the Invention

The invention relates to automatic doors and more particularly to a safety system for the controlled operation thereof.

2. State of the Prior Art

Although automatic operation of doors is well known as generally represented by U.S. Pat. Nos. 3,852,592, 4,029,176, 4,467,251, 4,577,437 and 4,604,826, none of the inventions covered thereby approach the invention covered hereby. The present invention is distinctive from the prior art in that it includes safety means operable to control object presence detecting beams by the open or closing movement of the door or doors.

SUMMARY OF THE INVENTION

The automatic door system covered hereby is primarily concerned with safety while at the same time providing effective control means for operation thereof.

The system of this invention is adaptable to using a conventional door beam sensing mechanism for the automatic operation thereof, although a manually actuated means may alternately be employed for effecting the door operation. Furthermore the system as applied to a sliding door structure employs at least two ultrasonic transducers mounted on the header of the door frame for transmitting beams across the center path of the doorway with which the system is included, that is the beams are adapted to be projected downward to cover the door opening as completely as possible. These latter beams are cone shaped and are placed in such a way to overlap each other, the purpose of which will hereinafter appear.

Each of the transducers produces a cone of high frequency and acts as a transmitter and receiver of sound pulses effective to the presence of an object in its beam. Appropriate circuits in the system control the timing and duration of the sound pulses. The transducers are actuated solely upon a predetermined movement of the door to turn them on and shut them off. After the conventional door opening beam effects the movement of the door to full open position, the movement of the door turns on each transducer in succession as it passes under and slightly beyond the transducer, thereby providing beam protection during the opening of the door from closed to open position.

In order to keep each transducer operating as long as possible when the door is closing, sensors and circuits are used to shut off each transducer in succession just ahead of the moving door. This means that the transducer or transducers as the case may be, next in succession will continue to operate effectively to detect presence in the beam. If there is no presence in each successive beam the door will continue to the closed position with the last beam being shut off just before the door passes under the transducer therefor.

When a controlling beam of conventional type is employed for initiating the opening of the door to which the present system is applied it is of the micro wave motion sensing type and can cover a wide range sufficient to span the door opening. In this way it is possible to intercept any moving object interrupting the beam and actuate the power means for operating the door. By reason of applying this system to a sliding door it is necessary to have similar or identical conventional micro wave beam means on both sides of the door whereas the ultrasonic transducer beams are therebetween in the open doorway into which the sliding door moves.

By reason of the nature of the beams produced by the ultrasonic transducers they are limited as to the area they can cover thus requiring more than one transducer effective to have each cover a certain area of conical shape and arranged to be in side by side overlapping relation capable together to span the width of the door opening.

With micro wave beams in continuous operation and the sliding door in its closed position the ultrasonic beams are off. Upon the movement of an object or person into the micro wave beam of either such beam in the system the power mechanism, for operating the door with which the micro wave beam detection is associated, causes movement of the door toward open condition. As long as the object moves and is in either of the micro wave beams the door opens fully and remains open. With the movement of the door to preselected positions along its open path, switches, connected in the electrical circuitry of the system, are tripped by the door to successively put on the ultrasonic beams. If an object or person in the course of movement through the doorway stops in the door opening, the ultrasonic beams being active under object presence will effectively maintain the door open until the object clears the doorway and beyond the micro wave beam on the egress side of the doorway. As the object leaves the ultrasonic beams and the door moves toward closed position it trips the switch connected with the ultrasonic transducer first in line to shut off the beam produced thereby and as the door moves further toward the closed position it trips the switch to shut off the next successive ultra sonic beam. The switches can be of the magnetic type and are arranged on the door frame header such that by circuit control and prearranged time delay the door can move a limited distance into the beam of each ultrasonic transducer without falsely causing the door to once again open as would be the case if not for the predetermined control circuity provided.

An object of the invention is the provision of a system for controlling the operation of an automatic actuated door which includes object presence detection means.

Another object of the invention is the provision of a system for controlling the automatic operation of a door which protects the movement or stoppage of an object or person in the doorway.

A further object of the invention is the provision of a control system for controlling the opening and closing of an automatically operated door wherein a conbination of movement and presence detection beam means are employed to protect the movement of a person through the doorway controlled by the door.

A yet further object of the invention is the provision of a system for controlling the movement of a sliding door wherein motion detection beams cause the ingress and egress of a person through the doorway controlled by the door and a plurality of presence detection beams cover the person's presence in the doorway.

The description of this invention is facilitated by reference to the drawings.

FIG. 1 is a fragmentary front plan view of a door arrangement embodying the invention.

FIG. 2 is a view taken along lines 2—2 of FIG. 1.

FIG. 3 is a top plan view of the structure of FIG. 2.

FIG. 4 is a cross-sectional view taken along 4—4 of FIG. 3.

FIG. 5 is a view taken along lines 5—5 of FIG. 1. and

DESCRIPTION OF THE PREFERRED EMBODIMENT

Figure 6:
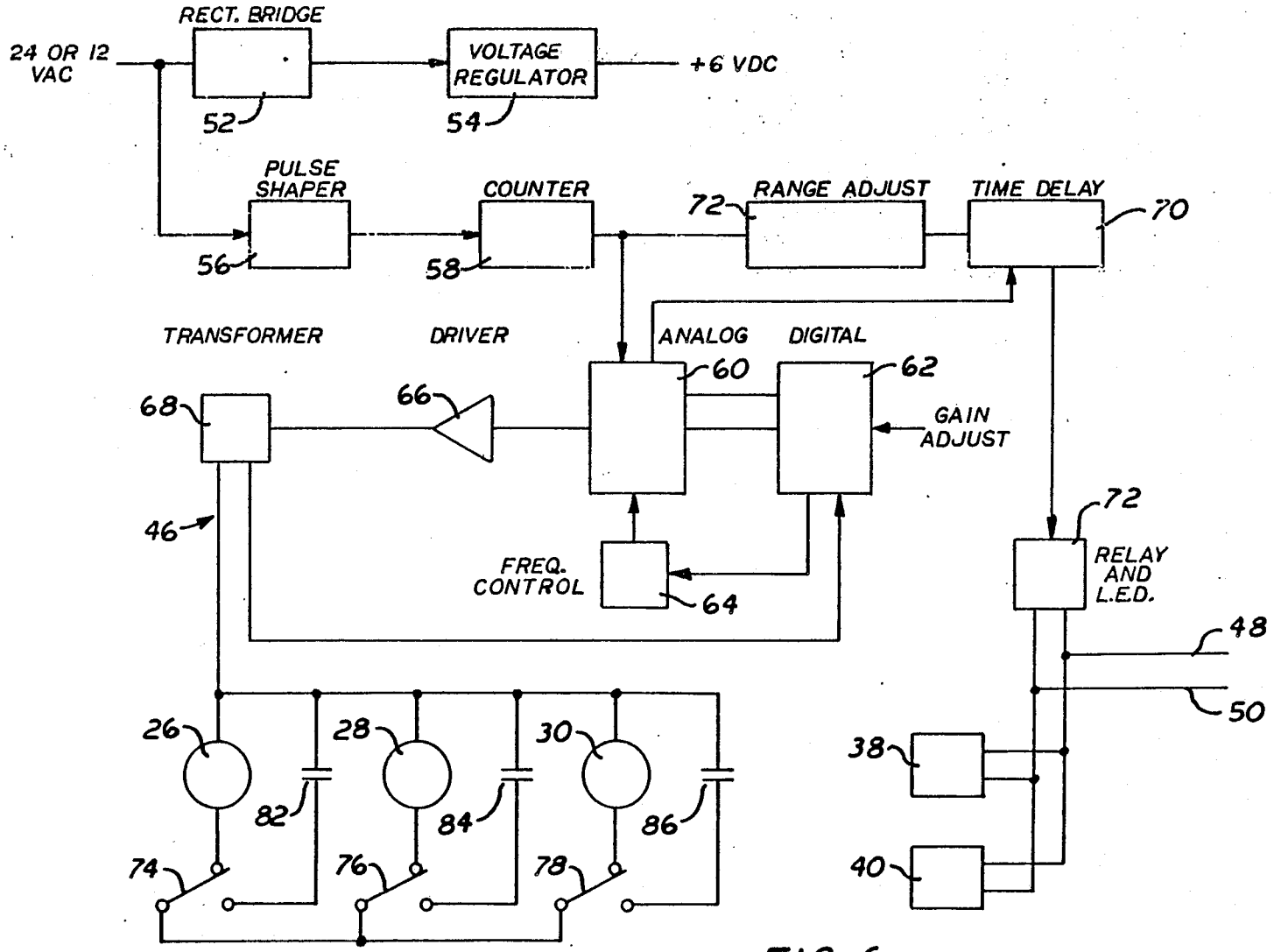
FIG. 6 is a block diagram of the electrical system for controlling the operation of the automatic door system covered hereby.

FIG. 1 is a front plan view of an automatic operated door arrangement 10, comprising a doorway opening 12 framed by side boards 14 and 16, header 18, a channel member assembly 20 mounted on the underside of header 18, a floor 22, and a sliding door 24.

Channel assembly 20 houses the circuitry of the invention disclosed by FIG. 6, which includes ultra-sonic transducers 26, 28 and 30 each effective when in operation to produce a cone of high frequency sound represented respectively by beams 32, 34 and 36 as disclosed in FIG. 1 and 5. The beams produced are conical in form with an end diameter of approximately 30 inches when at a height of seven feet. As noted the transducers 26, 28 and 30 are arranged to project their beams from the underside 37 of channel assembly 20 toward floor 22 but spaced a few inches from the floor at their largest diameter so as not to produce a false signal of detection. The beams are provided to overlap each other effective as a total to appropriately span the door and eliminate any voids for otherwise escaping detection when in the doorway surrounded by side boards 14 and 16, header 18 and floor 22. Each transducer acts as a transmitter and receiver of sound pulses and the circuit within which they are included, to be hereinafter described, provide means for controlling the timing and duration of the pulses.

In addition to the beams 32, 34 and 36 produced by transducers 26, 28 and 30, micro-wave motion detectors 38 and 40 are mounted on the face of header 18 on opposite sides of the doorway for producing beams 42 and 44. As noted these micro-wave motion detectors 38 and 40 are of conventional design and of the type in general use for the opening of sliding doors. The wave beams 42 and 44 are capable of being cast over a wide span and length effective to cover an area completely spanning the approach to the doorway opening 12 on both sides thereof.

As shown by block diagram FIG. 6 ultra-sonic transducers 26, 28 and 30 and micro-wave motion detectors 38 and 40 are incorporated in electrical system 46 which is connected at terminals 48 and 50 to door 24 power operating means, not shown. The system is so designed as to use either 12 or 24 volts A.C. for the operation thereof. The voltage is full wave rectified by rectifier bridge 52 and then applied to voltage regulator 54, which conditions the voltage to 6 volts D.C. for operation of all circuits in the system. The 60 HZ sine wave is used to lock the system to line frequency. Pulse shaper 56 forms a pulse to drive the trigger of counter 58. The counter in turn generates a square wave of a lower frequency which is used to drive an analog circuit 60 and also to generate a range window signal. Integrated circuits 60 and 62 contain all the circuits needed to drive the transducers 26, 28 and 30 and to receive and amplify the return echos thereof. A frequency control circuit 64 is used to set and control the frequency of the transmitted pulses. Driver 66 amplifies the pulses and drives the output transformer 68. The transformer in turn drives the transducers with 300 volt bursts of pulses. The transducers convert the voltage pulses and transmit through the air as shown by beams 32, 34 and 36. The return echos are also received by the transducers and fed back to circuit 62 to be amplified. The return echo is conditioned by circuit 60 and used to drive the time delay circuit 70 if it falls within the range time window. The time delay circuit then energizes relay and L.E.D. 72 with closure of the relay effective to activate the door circuits.

Motion detectors 38 and 40 are shown connected in parallel relation with relay 72 such that the detectors cause the door to open.

The range control circuit 72 has two modes of operation, one being manually adjusted whereby a desired range is selected or an automatic range adjustment made which sets the range at a predetermined distance from the floor. Time delay circuit 70 is adjustable from a time of ½ second to a time of 15 seconds and operates to hold the door relay closed for that period of time after no object is sensed.

Frequency control circuit 64 is adapted to have two modes of operation. The first is a fixed frequency mode in which the sound bursts are a set frequency and do not vary and the second is an automatic frequency which will automatically change the running frequency to a predetermined offset to any other unit operating in the vicinity. This is done to prevent crosstalk between units in proximity to one another.

Along with the provision of transducers 26, 28 and 30, the operational control thereof is effected by bi-stable magnetic reed switches 74, 76 and 78, for the respective transducers. A permanent magnet 80 is mounted on the top of door 24 near the leading edge thereof such that it can pass in close proximity to the switches 74, 76 and 78 as the door moves from closed to open position to successively turn on transducers 26, 28 and 30 and in a door closing operation to successively turn off the transducers in reverse order to their on condition. Capacitors such as 82, 84, and 86 are switched into the drive circuit in place of each transducer as it is disconnected in order to maintain a constant load on the driver circuits. This serves to keep the beam pattern size constant as the load is reduced one transducer at a time.

It is to be noted that although a beam of the micro-wave type, that is a motion sensing beam, can be made to cover a wide area and variation of shape, the ultra-sonic beam, that is a presence sensing beam is limited in size and shape thus accounting for the utilization of single beams 42 and 44 on each side of the door opening and at least three beams 32, 34 and 36 are required to cover a like width of door opening as a single beam 42.

Although the present system is more particularly applied to automatic sliding doors it can likewise be applied to automatic swinging doors. In that case the ultra-sonic presence detectors would be mounted on both the approach and swing sides of the door and wherein the relay controls would be connected to the door control such that the door would be prevented from opening if closed, held open if open, or switched to slow speed or stopped in motion.

Micro-wave motion detectors 38 and 40 and the beams produced thereby although perferable for use in a system of this type can be replaced by manual or pedally operated means for initiating the power operation of the door and serve the like function of the detectors 38 and 40 in placing the door in operation.

OPERATION OF THE AUTOMATIC DOOR

In the normal operation of door 24 the system is placed in the on mode wherein the micro-wave motion detectors 38 and 40 are continuously in operation and producing motion detecting beams 42 and 44. At the same time and with absence of any object or person moving in either of beams 42 and 44 door 24 remains closed thus completely blocking doorway passage or opening 12 and with transducers 26, 28 and 30 in an off position. With the movement of an object or person into either beam 42 or 44 the motion sensing ability thereof excites the circuit and operates the power motive means for the door to initiate the movement thereof to open door 24. With the movement of the door permanent magnet 80 engages successively the switches 74, 76 and 78 to operate successively transducers 26, 28 and 30 and produce presence detection beams 32, 34 and 36 to effectively move the door to full open position or maintain it open if an object or person is either moving or stationary in the path of any or all of beams 32, 34 and 36. Each of the transducers by being driven in parallel with each other avoid the possibility of separate circuits interfering with each other. As such each transducer is transmitting and receiving at the same time. It is to be appreciated that whereas beams 42 and 44 are motion detecting they will not serve to hold door 24 open if the object or person becomes stationary in its path. Thus the beams 32, 34 and 36 become active to hold the door open and afford assured safety to an object or person which might otherwise be in the path of the door if it were not assured of being held open. After the object or person moves through the doorway opening 12 and out of the range of all beams 32, 34, 36, 42 and 44, the door will be powered to closed position. During the closing motion of the door, permanent magnet 80, will operate to successively trip switches 74, 76 and 78. By reason of time delays built into the system the door moves partially into each successive beam and operates to shut off each beam before the beam acts to register presence of the door. The relay contacts are connected to the door control system such that the sensing of an object or person acts to hold the door open or cause it to reopen if in the process of closing.

It is to be appreciated that while the description is specific to the disclosure presented, variations are conceivable within the scope of the aforesaid description and accordingly, the appended claims are intended to define same.

What we claim is:

1. An automatic door structure having doorway comprising a door mounted for movement in said doorway, a plurality of stationary and moving object presence sensing detectors arranged to produce stationary and moving object presence sensing beams in overlapping relation to one another such that the beams, in alignment, fully span the doorway along the path of movement of the door and extend at least a predetermined distance on each side of the doorway, power means for actuating the door, and means arranged on the door operative upon movement of the door to open position to successively switch on each detector as it passes along its path to open position and effective upon reverse movement of the door to closed position to successively shut off each detector.

2. A door structure according to claim 1 wherein an electrical system includes, the detectors and power means therein, and switches for the detectors, with the means arranged on the door effective to open and close said switches depending on the movement of the door.

3. A door structure according to claim 2 wherein the beams, produced when the detectors are on, are conical in shape and have portions at their enlarged end in overlapping relation to one another to effectively close the doorway width so as when in on condition to detect the presence of any object in any position of the doorway.

4. A door structure according to claim 3 wherein the support structure for the door includes side boards, a header connected between the side boards and a floor and wherein the detectors are supported in spaced relation to one another on the underside of the header effective to cast the beams produced thereby in overlapping relation to one another and with the ultimate enlarged area of the beams approaching the floor.

5. A door structure according to claim 4 wherein switches, for putting the detectors on as the door moves to open position, are linearly arranged a predetermined distance beyond each detector in the opening direction of movement of the door, such that as the door moves to open position and its open end passes each switch, the means arranged on the door trip the switch to put the respective detectors on.

6. A door structure according to claim 1 wherein the detectors are mounted on the header of the support structure with the beams from said detectors being cast downward, and wherein the detectors are in off condition when the door is closed.

7. A door structure according to claim 1 wherein the detectors, when on, produce substantially conical beams in overlapping relation to one another with the beams being cast downwardly from the top of the support structure for the door.

8. A door structure according to claim 1 wherein the door is of the sliding variety and the beams are arranged to cover the path of movement of the door.

9. Mechanism for an automatic sliding door capable of moving to open position and closed position, said mechanism having power means for moving said door from closed to open position from a closed position and reversing the movement from open position to closed position comprising at least two stationary and moving object presence sensing detectors arranged above the door and spaced from one another in alignment with one another along the path of movement of the door for projecting overlapping stationary and moving object presencesensing beams along and in the path of movement of the door and capable when in beam producing operation of detecting the presence of any object either stationary or moving in the doorway of the door and the door has means effective upon opening movement of the door to engage and turn the detectors on in successive relation to one another and upon door closing motion to successively turn off the detectors.

10. Control mechanism according to claim 9 wherein the detectors are ultra-sonic transducers.

11. A control mechanism according to claim 9 wherein the power means includes motion detectors above the door on both sides thereof, with said detectors always in beam producing operation.

12. A safety system according to claim 9 wherein the detectors are supported on the underside of the header such that the beams cast thereby, when on, span the threshold of the door.

13. A safety system according to claim 12 wherein the beams produced by the transducers are conical in shape and projected downwardly to a predetermined limited distance from the floor and in overlapping relation to one another.

14. A safety system according to claim 13 wherein the beams extend at their large end on both sides of the doorway, means connected at the open end of the door near the top thereof effective upon movement of the door to open position to successively engage the switches for the transducers to turn on the beams and in closing movement of the door engages the switches to turn off the beams.

15. A safety system according to claim 14 wherein the power means for operating the door includes motion detecting means on each side of the door, mounted on the header, said detector means being in continuous beam producing operation with the area of each beam covering an area spanning the doorway and extending in front of the doorway beyond the area covered by the transducer beams.

16. An automatic door structure having a doorway comprising a door adapted to be mounted for sliding movement in the doorway, at least one presence sensing detector arranged directly above the path of movement of the door to produce a stationary and moving object presence sensing beam extending vertically downwardly to a predetermined limited distance from the floor of the doorway and spanning the doorway in and along the full path of movement of the door and extending a predetermined distance on each side of the doorway, power means for actuating the door, means for initiating operation of the power means effective to move the door to open position and to turn on the detector for stationary and moving object presence sensing beam operation.

17. A door structure according to claim 16 wherein the means for initiating operation of the door includes a motion sensing detector for producing a continuous object motion sensing beam on one side of the doorway in partial overlapping relation to the presence beam, such that movement of an object in the motion sensing beam provides for the initial actuation of the door to open position and whereupon with the presence sensing detector being placed in operation a presence beam is produced capable of detecting a moving or stationary object in the beam capable of continuing the operational opening of the door or maintaining the door in full open condition.

18. A door structure according to claim 17 wherein the power means for actuating the door includes another motion sensing detector for producing a continuous motion sensing beam, on the opposite side of the doorway from the first motion sensing beam, in partial overlapping relation to the presence sensing beam.

* * * * *